United States Patent [19]

Kirkland

[11] Patent Number: 4,606,293

[45] Date of Patent: Aug. 19, 1986

[54] EXPLOSIVELY ACTUATED MINE CABLE MARKER DEVICE

[75] Inventor: James L. Kirkland, Panama City, Fla.

[73] Assignee: The United States of America as represented by the Secretary of the Navy, Washington, D.C.

[21] Appl. No.: 776,058

[22] Filed: Sep. 13, 1985

[51] Int. Cl.[4] ..... B63B 9/00

[52] U.S. Cl. ..... 114/221 A; 24/115 R; 29/515; 89/1.14

[58] Field of Search ..... 114/221 A, 221 R; 89/1.14; 42/90; 102/415; 29/421 E, 421 R, 515, 243.5; 72/706; 24/703, 115 R

[56] References Cited

U.S. PATENT DOCUMENTS

| | | | |
|---|---|---|---|
| 2,455,826 | 10/1946 | Temple | 140/113 |
| 2,978,796 | 4/1961 | Kemeny | 29/156.8 |
| 3,120,827 | 2/1964 | Abegg et al. | 113/44 |
| 3,175,289 | 3/1965 | Wilterdink et al. | 30/180 |
| 3,882,811 | 5/1975 | Temple | 114/221 A |
| 3,931,726 | 1/1976 | Grubb | 72/430 |
| 4,112,862 | 9/1978 | Huly et al. | 114/221 R |
| 4,327,471 | 5/1982 | Whitted, III | 29/421 R |

*Primary Examiner*—Sherman D. Basinger
*Assistant Examiner*—Paul E. Salmon
*Attorney, Agent, or Firm*—Robert F. Beers; Harvey A. David

[57] ABSTRACT

A device for clamping a marker to a mine mooring cable upon severing by a cutter utilizes a V-shaped body having a liner that is explosively deformed into clamping engagement with the cable in response to cutter actuation. A smoke flare is included and ignited to provide a prolonged locating signal.

7 Claims, 3 Drawing Figures

EXPLOSIVELY ACTUATED MINE CABLE MARKER DEVICE

BACKGROUND OF THE INVENTION

This invention relates generally to the field of minesweeping and more particularly to an explosively actuated device for attaching a marker to the severed portion of a mine mooring cable as the cable is cut in a mine sweeping operation.

When a mine mooring cable is cut by a sweepwire carried, explosively actuated cutter, it is desirable to be able to locate the mine and destroy it. Because floating mines are difficult to sight visually in surface waves, it is desirable to provide some means of locating the freed mine, such as by a smoke flare, dye marker, sonic pinger, or the like, preferably by fixing the locating means to the portion of the cut cable that remains with the mine.

SUMMARY OF THE INVENTION

With the foregoing in mind, it is a principal object of this invention to provide a swept mine marker with an explosively actuated clamp that automatically secures itself to the mine portion of a mine mooring cable during severing thereof by a mine cable cutter.

Another object of the invention is to provide a marker and clamp combination that is readily carried by a mine cable cutter of the type wherein a cutting member is explosively driven to sever a mooring cable, the marker and clamp being responsive to actuation of the cutter to clamp to the severed cable and to generate a locating signal.

Still another object is to provide an explosively actuated clamp device wherein a V-shaped deformable member is carried in a correspondingly shaped backing member with an explosive therebetween so that detonation of the explosive causes the deformable member to collapse around a cable or other object in its reentrant confines and be securely clamped or fixed thereto.

Other objects and many of the attendant advantages will be readily appreciated as he subject invention becomes better understood by reference to the following detailed description, when considered in conjunction with the accompanying drawings.

DESCRIPTION OF THE PREFERRED EMBODIMENT

Figure 1:
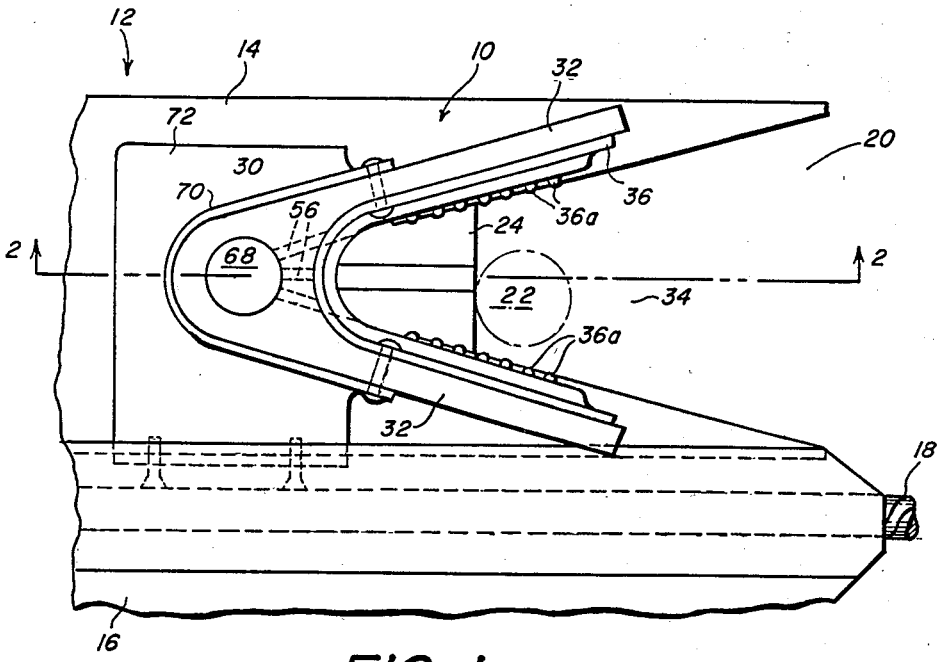
FIG. 1 is a plan view of a marker and clamp device embodying the present invention, shown in association with a fragmentary portion of a mine sweeping cutter.
Figure 2:
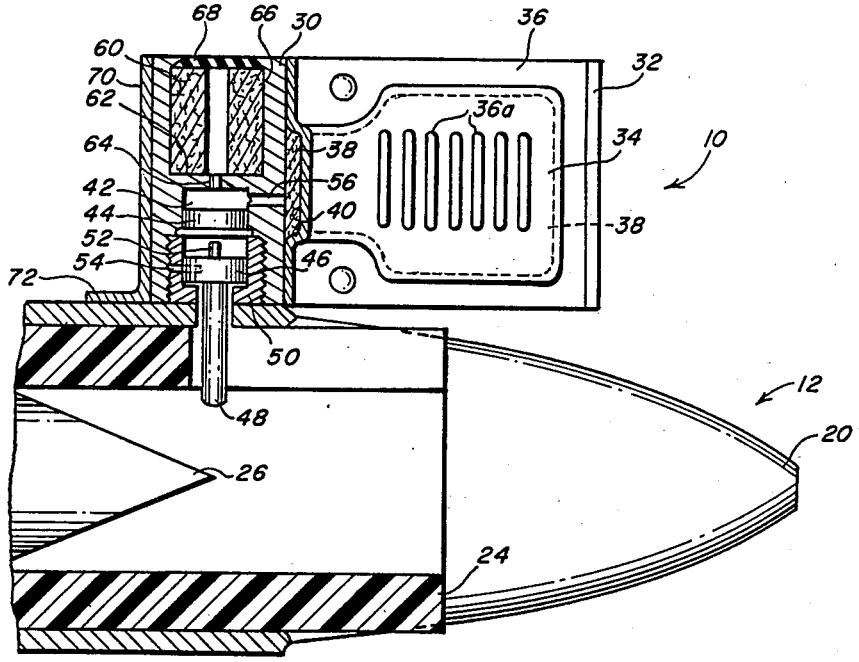
FIG. 2 is a vertical sectional view taken substantially along line 2—2 of FIG. 1.
Figure 3:
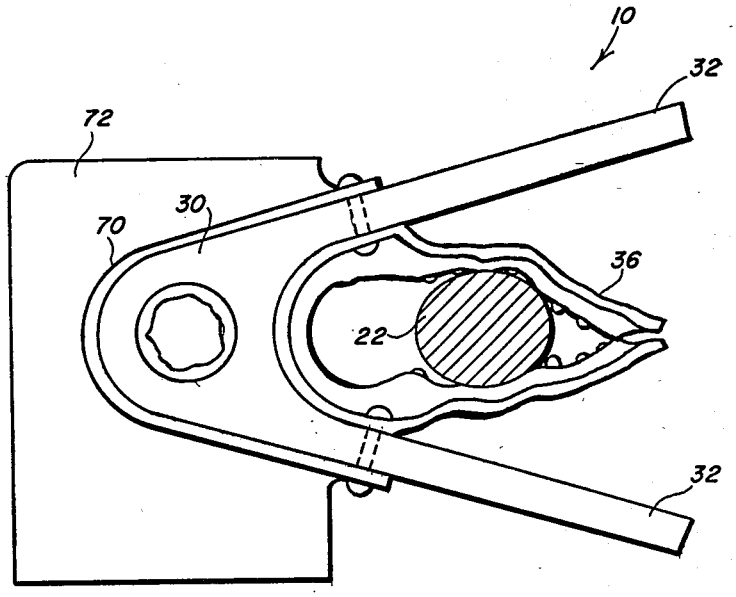
FIG. 3 is a fragmentary view showing the device after actuation.

Referring now to FIG. 1, an exemplary embodiment of an explosively actuated clamp and marker deivce according to the invention is generally indicated at 10 and is shown mounted on a minesweeping cutter generally indicated at 12. The cutter 12 is conveniently of the type shown described more fully in copending patent application, Ser. No. 751,831, filed July 5, 1985 and assigned to the assignee hereof. The clamp device 10 can be used as well, however, with other well known cutter devices. Suffice it to say briefly that the cutter device 12 comprises a body 14 mounted on an elevating fin 16 that is carried on a sweep wire 18. The body 14 is provided with a hook or recess 20 at its forward end into which a mine mooring cable 22 is guided during a sweep operation. The fin 16 assumes a horizontal position so that recess 20 is oriented to receive the vertical mooring cable 22. Referring additionally now to FIG. 2, a barrel 24 has an end exposed in recess 20 and carries a chisel 26 that is fired by an explosive charge (not shown) to cut the cable 22 when the cable pushes the barrel rearwardly.

The clamp and marker device 10 comprises a generally V-shaped body 30, formed for example of stainless steel. The body 30 has divergent arms 32 defining a recess 34 oriented substantially congruent to and above the recess 20 of the cutter. A deformable clamping member 36 is formed of a relatively soft malleable metal and is configured as a liner riveted to the apex area of the body 30. A layer of explosive material 38, conveniently in sheet form, is sandwiched between the clamping member 36 and each of the arms 32 of the body 30. The clamping member 36 is preferably shaped to provide a channel 40 in which edges of the explosive material 38 is exposed. To aid in gripping, the clamping member 36 may be provided with serrations or teeth **36*a***.

The body 30 is further provided with a bore 42 in the apex portion thereof in which is disposed a primer charge or cartridge 44 and a firing plunger 46. The plunger 46 has on one end thereof a push rod 48 depending through a threaded retainer bushing 50 into the path of the chisel 26. On the other end of the plunger is a firing pin 52. The plunger 46 is normally held by a shear pin 54 against movement. Passages 56 lead from bore 42 to the channel 40.

An additional bore 60 is formed in the body 30 and is separated from bore 42 by a wall 62 having a passage 64 therethrough. Disposed in bore 60 is a tubular marker cartridge 66 which, in this example is a smoke flare. A waterproof, fusible seal 68 closes the bore 60.

The body 30 is releasably held in its position relative to the cutter 12 by a bracket or support 70 that includes a foot portion 72 clamped between the body 14 and fin 16 of the cutter.

In operation, when a mooring cable is engaged the chisel is fired and, on its way to sever the cable, forces the push rod 48 to cause plunger 46 to shear pin 54 and drive firing pin 52 into the primer of primer cartridge 44. The latter sends an ignition flame via passages 56 and channel 40 to detonate explosive material 38. Detonation of explosive material 38 forcefully deforms the clamping member 36 around the cable 22 as the chisel 26 cuts that cable.

The ignition flame of cartridge 44 ignites the smoke flare 66 and burns or melts through the seal 68. The flare 66 continues to burn, relatively slowly, so as to generate smoke for a substantial period of time. The smoke rises into the air over the water where the mine has been cut free, thereby facilitating visual location of the mine.

As indicated in the aforementioned copending application, the recoil of the cutter body separates it from the fin and sweepwire. That occurrence releases the bracket 70 so that the marker and clamp device 10 is freed from the cutter and sweep wire and can travel toward the surface with the mine and the severed portion of the mine mooring cable to which the device 10 has become clamped.

As mentioned earlier, other forms of marking signal may be used, and they may be active or passive.

Obviously, other embodiments and modifications of the subject invention will readily come to the mind of one skilled in the art having the benefit of the teachings presented in the foregoing description and the drawing. It is, therefore, to be understood that this invention is not to be limited thereto and that said modifications and embodiments are intended to be included within the scope of the appended claims.

What is claimed is:

1. A device for marking the severed portion of a mine mooring cable during cutting thereof by a sweep wire carried cutter of the explosively driven chisle type, said device comprising:

a rigid body member adapted to be mounted on a cable cutter and having first and second arm portions extending from an apex portion so as to define a recess engageable by a cable to be cut by said cutter;

an explosively deformable clamp member having arm portions extending from an apex portion and nested in said recess so as to receive said cable, said clamp member being secured to said body member;

explosive material sandwiched between the arm portions of said body member and the arm portions of said clamp member; and firing means, responsive to actuation of said cutter, for igniting said explosive material to explosively deform said clamp member into gripping engagement with said cable.

2. A device as defined in claim 1, and wherein:

said deformable clamp member and said body member are fixed together in said apex portions.

3. A device as defined in claim 1, and further comprising:

marker means for use in locating said cable after being gripped by said clamping member and severed by said cutter.

4. A device as defined in claim 3, and wherein:

said marker means is responsive to actuation of said cutter to generate a signal indicative of the location of the severed portion of said cable.

5. A device for use in combination with a cable cutter having a cutter body defining a cable engaging first recess and a chisel operable to sever a cable in said first recess, said device comprising:

a V-shaped rigid body member having a pair of arms extending from an apex portion and defining a second recess;

means for mounting said body member with said second recess aligned with said first recess for simultaneous engagement by a cable to be cut and marked;

a clamp member having explosively deformable arm portions extending from an apex portion and nested in said second recess so as to receive said cable between said arm portions;

explosive material sandwiched between said arm portions of said clamp member and said arms of said body member;

said body member having a bore in said apex portion and defining passage means communicating between said bore and said explosive material;

a primer charge disposed in said bore;

plunger means reciprocable in said bore and including a firing pin aligned with said primer charge and a member extending into the path of said chisel so that actuation of said chisel will displace said plunger and cause said firing pin to fire said primer charge and detonate said explosive material, whereby said clamp member is deformed into clamping engagement with said cable.

6. A device as defined in claim 5, and further comprising:

marker means responsive to firing of said primer charge to generate an indicator signal.

7. A device as defined in claim 6, and wherein:

said marker means comprises a smoke flare operable to generate smoke for a predetermined time period after cutting of said cable.

* * * * *